US009629443B2

(12) United States Patent
Searle et al.

(10) Patent No.: US 9,629,443 B2
(45) Date of Patent: Apr. 25, 2017

(54) DYNAMIC LOAD CARRIAGE FRAME

(71) Applicant: BCB International Limited, Cardiff, South Glamorgan (GB)

(72) Inventors: Matthew Searle, Bruton Somerset (GB); Christopher Mark Lewis, South Glamorgan (GB)

(73) Assignee: BCB INTERNATIONAL LIMITED, Cardiff (GB)

( * ) Notice: Subject to any disclaimer, the term of this patent is extended or adjusted under 35 U.S.C. 154(b) by 0 days.

(21) Appl. No.: 14/773,918

(22) PCT Filed: Feb. 12, 2014

(86) PCT No.: PCT/GB2014/050410
§ 371 (c)(1),
(2) Date: Sep. 9, 2015

(87) PCT Pub. No.: WO2014/140519
PCT Pub. Date: Sep. 18, 2014

(65) Prior Publication Data

US 2016/0022018 A1 Jan. 28, 2016

(30) Foreign Application Priority Data

Mar. 13, 2013 (GB) ..... 1304542.2

(51) Int. Cl.
*A45F 3/10* (2006.01)
*A45F 3/08* (2006.01)
*A45F 3/14* (2006.01)

(52) U.S. Cl.
CPC ..... *A45F 3/10* (2013.01); *A45F 3/08* (2013.01); *A45F 3/14* (2013.01)

(58) Field of Classification Search
CPC .... A45F 3/08; A45F 3/047; A45F 3/04; A45F 3/06; A45F 2003/045
See application file for complete search history.

(56) References Cited

U.S. PATENT DOCUMENTS 4,982,884 A * 1/1991 Wise ..... A45F 3/04 224/197
5,004,135 A * 4/1991 Dufournet ..... A45F 3/047 224/262

(Continued)

FOREIGN PATENT DOCUMENTS

WO 2004/082426 9/2004
WO 2013/008001 1/2013

OTHER PUBLICATIONS

WO patent application No. PCT/GB2014/050410, International Ssearch Report and Written Opinion mailed Jun. 12, 2014.

*Primary Examiner* — Corey Skurdal
(74) *Attorney, Agent, or Firm* — Weaver Austin Villeneuve & Sampson LLP

(57) ABSTRACT

A load carriage frame (80) of FIG. 9 includes a shoulder yoke (90) and a belt (120) separated from the yoke by a multi-element connecting brace (96). The brace is telescopic in nature in that a flexible but rigid tongue (130), extending from a first section, is permitted to slide within a guide on a second section (154), thereby allowing the length of the connecting brace to be altered. The multi-element connecting brace is centrally coupled to the yoke and centrally coupled to the belt and configured to act as a force path by transferring weight that, in use, is loaded onto or through the yoke and into the belt thereby effecting selected weight re-distribution onto the pelvic girdle of a wearer about which the belt, in use, is secured. Additionally, as shown in FIG. 20, a quick release mechanism may further alter the length of the connecting brace by allowing the position of a rotational coupling point to be altered relative to a housing of the quick release mechanism. The quick release mechanism can, in fact, be used with a single piece connecting brace.

23 Claims, 8 Drawing Sheets

(56) References Cited

U.S. PATENT DOCUMENTS

| | | | | |
|---|---|---|---|---|
| 5,449,102 | A * | 9/1995 | Sason | A45F 3/047 224/632 |
| 6,536,641 | B1 * | 3/2003 | Sundara | A45F 3/08 224/631 |
| 8,182,439 | B2 | 5/2012 | Glenn | |
| 8,991,671 | B2 * | 3/2015 | Gill | A45F 3/04 224/628 |
| 9,332,821 | B2 * | 5/2016 | Janssen | A45F 3/04 |
| 2010/0076359 | A1 * | 3/2010 | Glenn | F41H 1/02 602/19 |
| 2014/0151424 | A1 * | 6/2014 | Hexels | A45F 3/06 224/637 |
| 2014/0305982 | A1 * | 10/2014 | Pelland | A45F 3/06 224/576 |
| 2015/0189974 | A1 * | 7/2015 | Bercaw | A45F 3/04 224/633 |

* cited by examiner

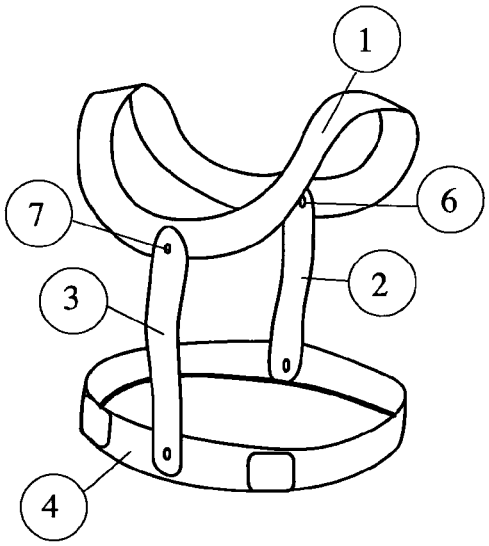
Figure 1: Prior Art
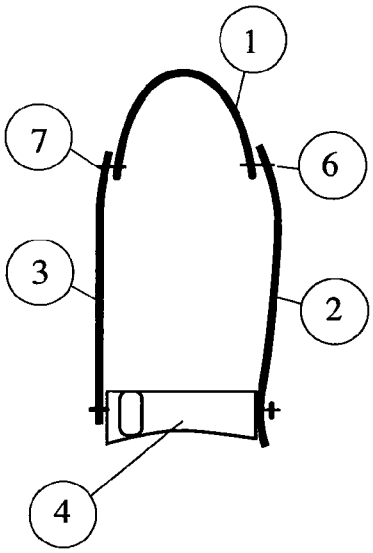
Figure 2: Prior Art
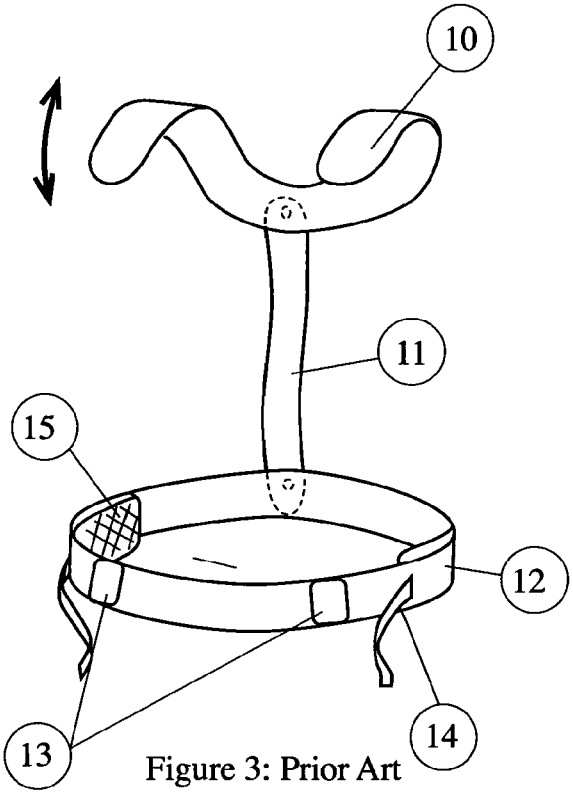
Figure 3: Prior Art
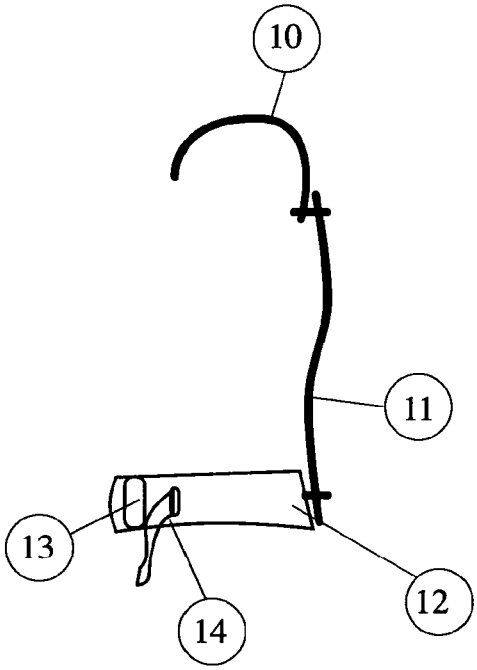
Figure 4: Prior Art

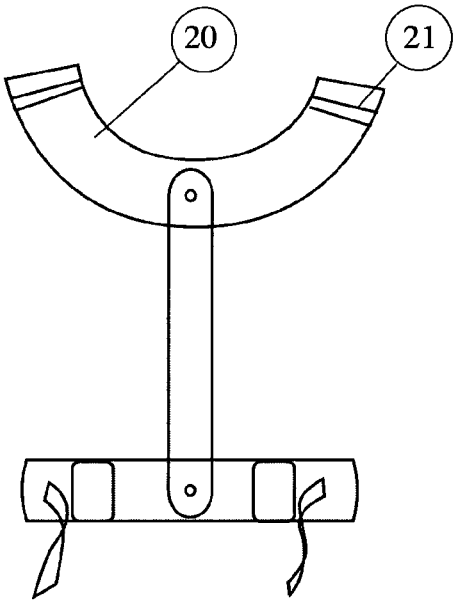
Figure 5: Prior Art
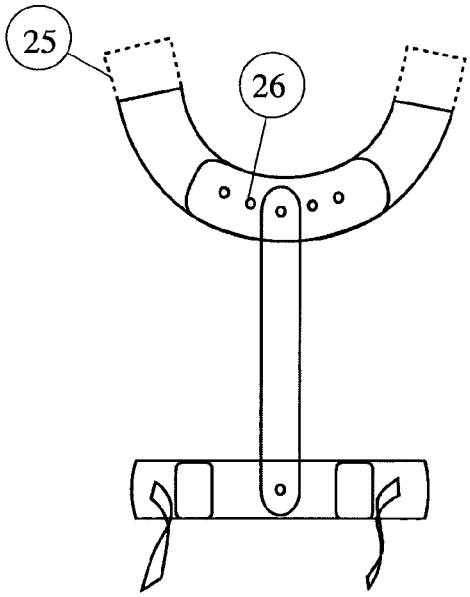
Figure 6: Prior Art
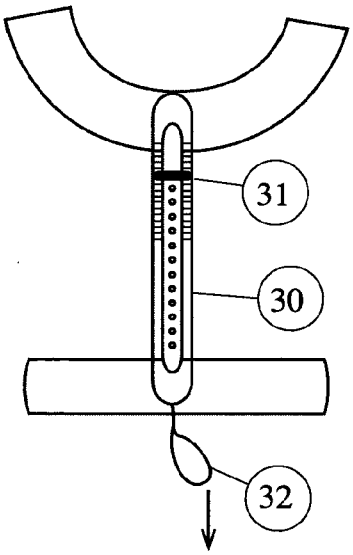
Figure 7: Prior Art
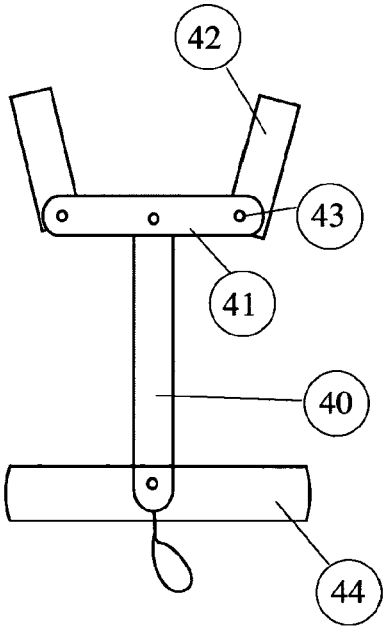
Figure 8: Prior Art

DYNAMIC LOAD CARRIAGE FRAME

BACKGROUND TO THE INVENTION

The present invention relates to a load carriage frame and specifically, but not exclusively, to a load carriage frame used when wearing armour vests or otherwise in generally supporting carriage of a user-worn load, such as a rucksack. The invention is particularly applicable to an active or dynamic load carriage frame used by infantrymen in hostile military operations.

SUMMARY OF THE PRIOR ART

Current body armour vests are heavy. Additionally a person who is wearing a vest incorporating body armour may have to carry a rucksack or other load. This load can to attached directly to the vest or be a separate item. The weight of the vest and the weight of the additional load is presently carried on the shoulders of the wearer. It is well known by physiologists and those skilled in the art that it is preferable to support at least some of the load on the pelvic girdle rather than solely on the shoulders. Some rucksacks are fitted with belts to transfer some of the weight to the pelvic girdle. However, the wearing of body armour vests prevents the use of belts as the armour covers the waist.

High pressure on the shoulders is uncomfortable, puts stress on the spine and in particularly extreme cases blood flow can be occluded from muscle at applied pressures of typically 14 kPa (Holloway et al., 1976). Most military systems and even newer commercial systems can create shoulder pressures in excess of 20 kPa when loaded with 35 kg loads (Stevenson et al., 1997).

A known armoured vest incorporating load distribution is KDH Coreload plate carrier. This vest, as disclosed in WO 2010/059951, consists of a flexible yet rigid back brace, a waist belt wherein the waist belt is connected through a housing to back brace, and a vertical and circumferential tensioning mechanism. The KDH system does not transfer any external load, such as a rucksack, from the shoulders to the waist.

U.S. Pat. No. 8,182,439 describes a body support system having a frame with a vertical section that couples with a shoulder section and a hip section that are flexible and configured to fit over the shoulders and around a user's hips. The hip elements are coupled to the vertical section and allow limited pelvic rotation around vertical axis orthogonal to the vertical section. The hip elements are configured to use a latching hip strap to couple hip padding to the hip elements. The vertical section may have spinal padding for the thoracic portion of the spine. The shoulder section has shoulder elements are curved and coupled to form a yoke that fits over the shoulders. The yoke may couple to lifting straps. The vertical section may be curved to conform to the shape of a user's back. The hip section is rigidly coupled along the vertical axis and pivotally coupled in other directions allowing the user a range of side-to-side motions relative to the vertical axis. The length of the back brace is fixed by virtue of the fixed upper and lower connections.

WO 2013/008001 describes a load carriage frame for armour vests.

SUMMARY OF THE INVENTION

According to a first aspect of the present invention there is provided an active load carriage frame comprising: a shoulder yoke; a belt for securing, in use, about a pelvic girdle; and a multi-element connecting brace separating the shoulder yoke from the belt, the multi-element connecting brace centrally coupled to the yoke and centrally coupled to the belt and configured to act as a force path by transferring weight that, in use, is loaded onto or through the yoke and into the belt thereby effecting weight re-distribution onto the pelvic girdle of a wearer about which the belt, in use, is secured, and wherein: the multi-element connecting brace comprises: an upper section and a lower base section that are slideably engageable with each other through a flexible connecting element, wherein the connecting element extends from and is fixedly coupled to one of the upper section or the lower base section and is engageable at a variable coupling point along part of its length by the other one said lower base section or said upper section, the variable coupling point being, at times, part of the force path between the shoulder yoke and the belt.

In another aspect of the present invention there is provided an active load carriage frame comprising: a shoulder yoke; a belt for securing, in use, about a pelvic girdle; and a multi-element connecting brace separating the shoulder yoke from the belt, the multi-element connecting brace centrally coupled to the yoke and centrally coupled to the belt and configured to act as a force path by transferring weight that, in use, is loaded onto or through the yoke and into the belt thereby effecting weight re-distribution onto the pelvic girdle of a wearer about which the belt, in use, is secured, and wherein: the multi-element connecting brace comprises: an upper section and a lower base section that are slideably engageable with each other through a flexible connecting element, wherein the connecting element extends from and is fixedly coupled to one of the upper section or the lower section and is engageable at a variable coupling point along part of its length by the other one said lower base section or said upper section, the flexible connecting element automatically adjusting separation between the shoulder yoke and the belt by acting as a bridge between the upper section and the lower base section.

In a preferred embodiment, the flexible connecting element is configured to bend and twist and is in the form of a flexible, Kevlar®-based tongue.

The multi-element connecting brace is preferably pivoted at its point of connection to at least one of: a) the shoulder yoke; and b) the belt, thereby allowing the wearer's shoulders and/or the torso independent movement.

The shoulder yoke preferably includes shoulder pads rotatably attached at peripheral ends of a cross member that is centrally pivotally coupled to an upper section of the multi-element connecting brace.

In some embodiments, the active load carriage assembly may further comprise: a ratchet assembly fixed centrally in the belt, the ratchet assembly including: a quick-release locking mechanism including a locking pin; and a moveable member contained within a housing, the moveable member having: a first end containing a connection point; a second end opposite the first end; and a plurality of engageably selectable holes or splines extending along the length of the moveable member away from the first end towards the second end, each of the plurality of engageably selectable holes or lips receptive to engagement by the locking pin; wherein the connecting brace is rotatably coupled to the moveable member at the connection point, and wherein the quick-release locking mechanism is arranged to permit the locking pin to be selectively engaged into a selected one of the plurality of holes or lips, thereby altering the relative position of the connection point within the housing.

In a further aspect of the invention there is provided a load carriage frame comprising: a shoulder yoke; a belt for securing, in use, about a pelvic girdle; and a ratchet assembly fixed centrally in the belt, the ratchet assembly including: a quick-release locking mechanism including a locking pin; and a moveable member contained within a housing, the moveable member having: a first end containing a connection point; a second end opposite the first end; and a plurality of engageably selectable holes or splines extending along the length of the moveable member away from the first end towards the second end, each of the plurality of engageably selectable holes or lips receptive to engagement by the locking pin; a connecting brace separating the shoulder yoke from the belt, the connecting brace centrally coupled to the yoke and rotatably coupled to the moveable member at the connection point, the connecting brace configured to act as a force path by transferring weight that, in use, is loaded onto or through the yoke and into the belt thereby effecting selective weight re-distribution onto the pelvic girdle of a wearer about which the belt, in use, is secured; wherein the quick-release locking mechanism is arranged to permit the locking pin to be selectively engaged into a selected one of the plurality of holes or lips, thereby altering the relative position of the connection point within the housing.

The invention relates especially to a load transfer frame that can be integrated into an armour vest and can transfer weight from the shoulder straps of a rucksack or other secondary load to the waist belt that in turn transfers the load to the wearer's pelvic girdle. The belt can be used to support traditional belt-kit and have other loads such as pouches attached directly to it.

Advantageously, a preferred embodiment of the present invention provides a low-cost, low part-count, portable, lightweight and comfortable load transfer system that helps reduce load carriage injuries and stress, thereby improving the overall operational performance or efficiency of the wearer. Beneficially, the simplicity of construction and the flexible nature of the materials used to produce the device allow the wearer to move freely without impinging on any dexterity. Furthermore, the self-contained nature of the system means that the load carriage system is without tethers or restrictive ties.

The present invention provides a solution to load support by selectively transferring some of the weight of the vest and/or any external load to the wearer's pelvic girdle, especially through the provision of a self-adjusting back brace. In other words, the preferred embodiments allow for dynamic variation in the frame so as to accommodate different movements, including bending.

Another embodiment permits for wearer independently to adjust the weigh distribution between the pelvic girdle and the shoulders through re-positioning of the location of the pivotal base pin that attaches the back brace to the belt of the load carriage. This repositioning therefore adjusts the overall length of the back brace, with this ability to regulate load/weight distribution beneficial because different activities (such as marching or snipping) require different weight distributions. For example, when marching, loading of the pelvic girdle reduce fatigue by removing weight from bearing down on the shoulders. Conversely, when firing a weapon or crawling along the ground, having the weight off the shoulders actually diminishes soldier manoeuvrability, so collapsing the load carriage and engaging the yoke against the shoulders is desirable. Pivot height adjustment through a ratchet or sliding bolt system means that the back brace can effectively be lengthened or shortened whilst being worn by the user so that weight can be selectably transferred from the shoulders to the hips and vice versa.

BRIEF DESCRIPTION OF THE DRAWINGS

Exemplary embodiments of the present invention will now be described with reference to the accompanying drawings, in which:

FIG. 1 is a perspective view of a load transfer device according to WO 2013/008001.

FIG. 2 is a side view of a preferred embodiment of WO 2013/008001;

FIG. 3 is a perspective view of another embodiment of WO 2013/008001;

FIG. 4 is a side view of FIG. 3.

FIG. 5 is a front view of a load transfer device of WO 2013/008001 with adjustable shoulder pads and belt.

FIG. 6 is a front view of a load transfer device of WO 2013/008001 with adjustable yoke.

FIG. 7 is a front view of a height adjustable brace described in WO 2013/008001.

FIG. 8 is a perspective view of a whipple tree arrangement in WO 2013/008001 that provides for independent articulation of shoulder supports of a yoke;

DETAILED DESCRIPTION OF A PREFERRED EMBODIMENT

Figure 9:
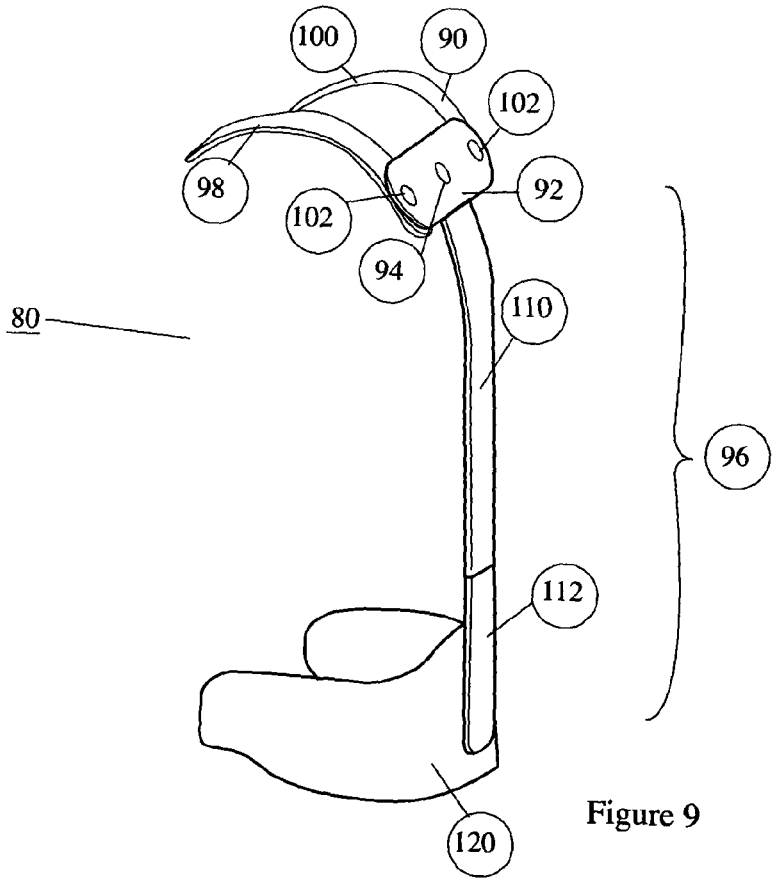
FIG. 9 is a representation of a telescopic load carriage according to a preferred embodiment of the present invention.

To provide a context for the invention, reference is made to FIGS. 1 to 8 that describe devices and systems for transferring weight from the shoulders of the wearer to the pelvic girdle of the wearer. The device is particularly applicable to a load carriage for supporting armour vest or the like. The weight distribution system, in overview, comprises an adjustable padded belt secured to a load bearing back brace that in turn is attached to a shoulder yoke. The yoke supports the weight of the vest via the shoulders of the armour and any other load such as a rucksack and transfers the weight via the back brace to the belt and the wearer's pelvic girdle. The yoke covers the shoulders (of the wearer) and is mounted either above the armour and attached to it by tension members or the yoke is mounted below the armour and holds the armour up. A soft armour pack of the armour vest can either be located inside or outside of the weight distribution device. In cases where the armour pack is located inside of the weight distribution device, the weight distribution device has a U shaped section to transfer load under the bottom edge of the armour pack to the load-bearing belt.

The upright brace or braces (as the case may be) is/are adjustable in height. This allows the vest to be fitted to different size wearers, with the adjustment reliant upon the positioning of a pin into one of a number of selectable holes. In vests with a front brace the front brace can be released or otherwise unloaded to allow the wearer to bend forwards without the brace acting against them. The yoke is typically realised as an articulated whipple tree harness, such as described in WO2010007343.

In FIGS. 1 and 2, a load carriage device transfers weight from the shoulders of a wearer of body armour to the wearer's pelvic girdle by means of a yoke 1, load bearing braces 2, 3 and a belt 4. The yoke 1 is attached to the braces 2, 3 by pivots 6, 7.

Referring to FIGS. 3 and 4, a yoke 10 is attached to a back brace 11 that transfers compression load to belt 12, The back brace 11, as seen in the accompanying drawing figures, is rigid and resilient since it may be made from aluminium or a composite (as described above) and therefore operates to separate (and maintain separation) of the yoke from the belt such that a load (such as shoulder strapping of a rucksack) mounted on or supported across the yoke forces (under action of gravity) the brace downwards in a compressive sense. The back brace 11 therefore acts as a force path for load acting on the yoke and for commuting that load into the pelvic girdle.

The back brace may actually be hollow or contain a groove in its surface, with the resulting cavity used for trunking, i.e. a cable run. Furthermore, whilst the back brace acts as a force path, the back brace may take on a multi-element construction and, in this respect, may include some limited spring that acts to dampen/cushion the vertical movement of the brace into its connection point on the belt. The spring, which may be entirely mechanical in nature or based on an air-piston or the like, may be positioned towards the top, bottom or middle sections of the back brace. For example, the brace may comprise an upstanding outer barrel connected to the belt and an inner piston that attaches to the yoke and which to abuts against a spring seated inside the outer barrel (towards its base). The inner piston therefore rides up and down within the outer barrel, with the combination of the outer barrel, inner piston and spring functioning as a generally rigid but slightly dampened force path. Moreover, it is contemplated that movement of the piston could be tapped as a source of energy, where the kinetic energy associated with relatively small (but high resistance) movements within the back brace is converted by a dynamo and stored in a battery for future use.

The belt 12 is secured by one or more buckles 13 and is adjustable in length by pull straps 14. The belt 12 can include adjustable pads 15 to spread the weight onto the pelvic girdle without causing trauma to the wearer. The brace 11 can be shaped to fit the natural curvature of the wearer's spine.

Turning to FIG. 5, yoke 20 can be made to conform more to the wearer's shape by means of adjustable shoulder pads 21. FIG. 6 shows an adjustable yoke 25 with means 26 to change length and angle of the two wings of the yoke. Means of adjusting length of load bearing members is well known in the art and many different solutions may be used to achieve the same function.

Referring to FIG. 7 the front brace 30 can be adjusted in length by pulling loop 32 to release lock 31, such as a snagging clasp. This allows the wearer to bend forwards without restriction. When loop 32 is released, the front brace 30 can re-lock again to transfer load from shoulders to pelvic girdle.

FIG. 8 shows a weight distribution device with an additional element of a bridge 41 joining articulated shoulders 42. FIG. 8 amounts to a whipple tree arrangement in that the shoulders are independently pivotally jointed 43 at peripheral points of the bridge 41, with the shoulders sections of the yoke therefore able to rotate around the pivot 43 and raise because of the interacting relationship between the support brace 3 and the pivots 6 and 7 that connect the bridge 41 and the belt 4. The shoulders 42 are connected by a pivoting bridge 41 to the brace 40. Load is transferred via brace or braces 40 to belt 44.

The load transfer frame can be provided as a separate unit that itself includes an inner (body-facing) surface having a cushioned liner or padding that, optionally, includes fluted cooling channels. As will be readily appreciated, the liner may be moulded or formed from strategically placed pads made from high-density foam or molded in suitable plastics material or other made from other materials, including natural fibres. In providing an independent load frame, such as shown in FIGS. 3 and 4, the load frame can be deployed for use with any armour vest or to support suspended loads slung across or carried on the shoulders of a person. Of course, as indicated above, the load frame can also be directly integrated into a conventional armour vest, with the integration producing either: i) a sandwich of the load transfer frame between the aforedescribed fluted liner and the actual vest that carriers soft or hard armour plate; or ii) an inner, body-facing surface that rests against the back of the wearer. In the latter respect, the load frame is therefore immediately inward of the fluted moulding or immediately inward of the actual armour vest.

The yoke, back brace and at least an arc-shaped portion of the belt may be unitarily moulded as a single piece. Alternatively, the yoke and back brace may be unitarily moulded together and then a base of the back brace secure into a lumbar belt which, preferably, also includes at least one of internal cushioning, MOLLE and an adjustable buckle that permits dimensions of the waist to be altered to fit the user. The constituent pieces of the load frame may, of course, all be manufactured separately and then assembled.

The braces are pivoted top and/or bottom where they connect to the belt and/or yoke allowing the shoulders and/or the torso some independent movement. The amount of pivoting movement about the point of rotation is preferably limited to a range of about +/−20 degrees from a central (neutral) position, with the restricted movement realised typically by a pin or lug (as will be understood). Typically, the shoulders of the yoke rest on foam shoulder pads. The angle of these pads can be adjusted to allow the armour to fit wearers with different shape shoulders. The pads provide a degree of cushioning, especially since the re-distribution of weight through the brace to the pelvic girdle may not be total.

From a constructional perspective, the yoke and braces are made from either composites or other materials, such as aluminium, that can withstand heavy loads and high-speed impacts without shattering or splintering.

The inner surface of the armour vest is lined with a moulded, fluted element to help keep the wearer cool. The inner liner therefore provides a degree of cushioning against the back of the wearer, with the fluting permitting air to circulate through the fluted channelling in the moulding.

The specifics and underlying concepts described above and shown in FIGS. 3 to 8 can, however, be augmented by the concept of dynamic variation in the in the length of the back brace and/or in situ wearer-initiated re-positioning of the pivot position within the belt, as outlined and detailed below with respective reference to FIGS. 9 to 13 and 14 to 22.

Figure 15:
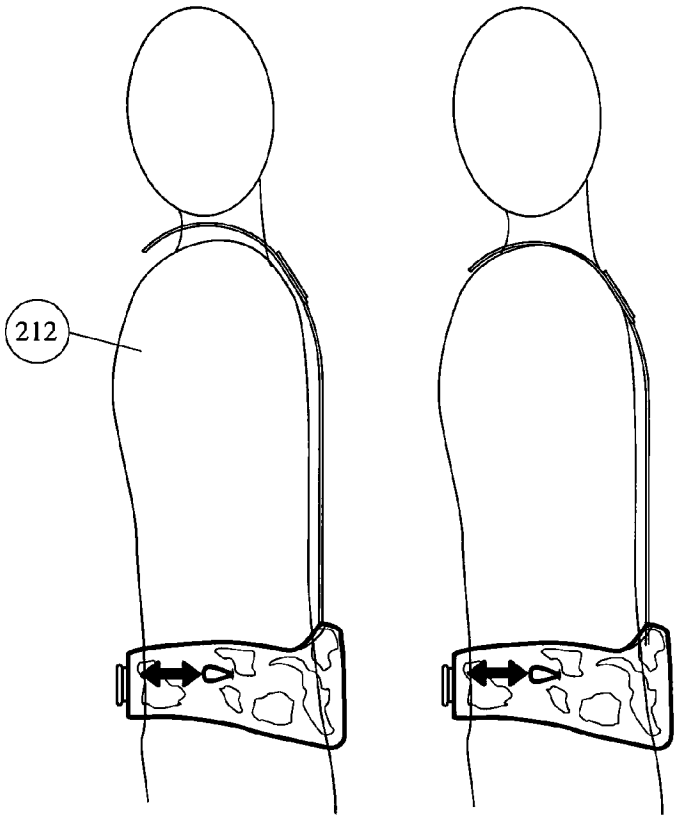
FIG. 15 shows the relative physical loading, on a body, achieved by operating the ratchet release system of FIG. 14.
Figure 14:
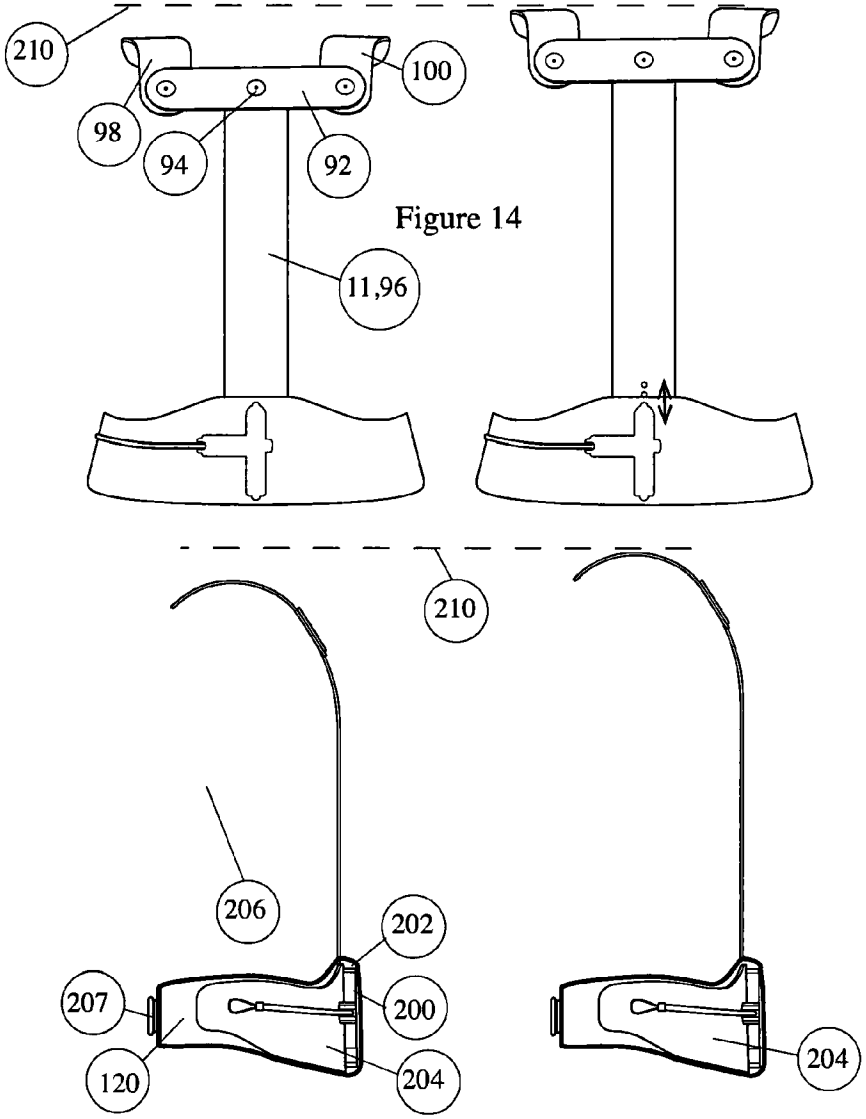
FIG. 14 show a ratchet release system for a user-adjustable back brace, the ratchet release system integrated in the load carriage of FIGS. 9 to 13 or the load transfer device of FIGS. 1 to 12.

With regard to FIGS. 14 and 15, a load carriage 80 includes a yoke 90 that is formed from a centrally-pivoted cross-member 92 that is attached by a pin 94 to a multi-element or telescopic back brace 96. Partially curved left and right shoulder supports 98, 100 are pivotally attached respectively to each end of the cross-member 92 through pins 102. The yoke 90 therefore realises a whipple tree arrangement in that both shoulder supports 98, 100 are independently rotatable relative to the cross-member 92 and that both shoulder supports can raise and lower (relative to a horizontal plane) as a consequence of pivotal movement of the cross-member relative to the multi-element back brace 96. The shoulder supports may include some form of padding (not shown).

The multi-element back brace 96 includes an upper section 110 and a lower base section 112 that are slideably or telescopically engageable with each other. The upper section 110 couples to the cross member 92 through the pin 94 about which the cross-member rotates. The upper section 110 may include a plurality of adjustment holes located in a vertical line that permit the length of the upper section to be varied upon selected insertion and securing of the pin 94; this provides a basic length variation at the point of set-up of the load carriage 80. The lower base section 112 is pivotally attached through a base pin (see FIG. 18) to a support belt 120. The base pin (reference numeral 240 of FIG. 18) preferably allows the telescopic back brace to rotate side-to-side about the base pin, typically through a limited angle of about twenty degrees. The connection may, however, be more rigid in nature.

Relative telescopic movement of the upper section 110 and the lower base section 112 therefore dynamically extends the length of the back brace 96; this is ergonomically important from the perspective of allowing the wearer of the load carriage 80 to bend forward or straighten. When bending forward, the wearer's back effectively lengths, so the preferred configuration of a telescopic back brace 96 compensates for this physical effect. The telescopic nature of the back brace 96 permits an extension typically between about five and 10 centimeters.

In an upright position, as shown in FIG. 9, the upper section 110 and the lower base section 112 are closed and abut against each other to provide a fixed length, rigid back brace. This configuration ensures that, subject to the initial setting of the connection point to the cross member and location of the base pin in the support belt 120, any load supported by the yoke is effectively transferred from the shoulder regions of the wearer to the pelvic girdle of the wearer.

Figure 10:
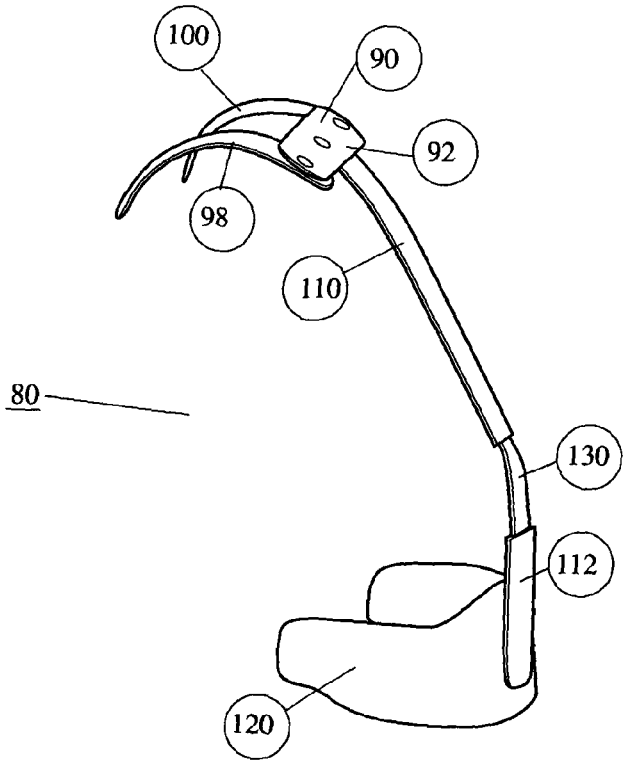
FIG. 10 shows the telescopic load carriage of FIG. 9 in an extended position.

In FIG. 10, it should be noted that the upper section 110 has slid relative to the lower section 112 to reveal a self-supporting tongue 130. The tongue 130 is typically made from a para-aramid, such as a Kevlar®-epoxy composite, that is strong, generally rigid but with a degree of elasticity allow the tongue 130 (at least) to bend as the telescopic action exposes the tongue by extends the point of separation between the upper and lower sections 110, 112 of the multi-element back brace 96. Other materials and chemical species may be used, with material selection based on a requirement to eliminate the likelihood of splintering or fragmentation of the tongue under ballistic impact or stress. The action of the wearer bending over changes the centre of gravity of the wearer (and load carriage) and causes a redistribution of load supported by the yoke away from the pelvic girdle of the wearer and onto the wearer's shoulders through a more active engagement of the shoulder supports.

The tongue 130 may be realised by a variety of mechanical arrangements, including one or more concentric pipes. Preferably, slideable member engagement is through a wide and relatively flat flexible plate that twists and bends in a complementary fashion to the human spine.

Referring to FIGS. 11 to 14, a preferred telescopic design of the back brace 96 is shown. As indicated above, the lower section 110 is attached to the belt 120 through the base pin.

Figure 11:
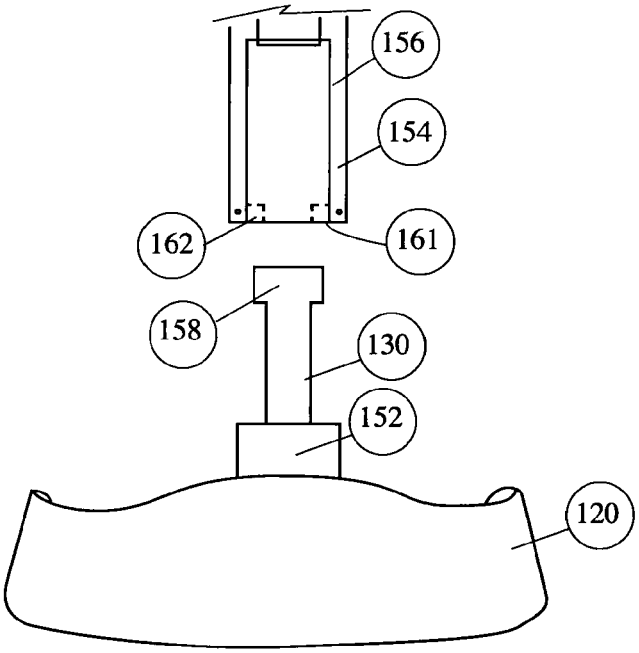
FIGS. 11 to 13 show interacting components in a preferred configuration for the telescopic load carriage of FIGS. 9 and 10.

In FIG. 11, the lower section 112 includes a rigid but bendable tongue 130 that extends from a base housing 152 coupled to the belt 120. The base housing 152 therefore provides a physical abutment surface against which an upper housing 164 (in the upper section 110 of the back brace 96) can sit and positively engage. The upper housing 154 therefore acts as a guide for the tongue 130 and preferably includes a guide channel or guide rail 156 that cooperates with the tongue 130 to define a limited path of relative telescopic or slideable movement. The guide channel 156 may be lubricated to reduce frictional effects. Any bending or straightening movement therefore sees the upper and lower housings separating or coming together in a generally and preferably smooth fashion.

Figure 12:
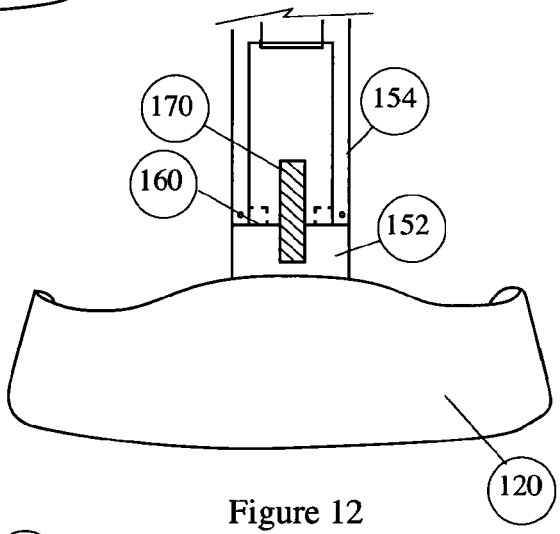

Abutment of a contact surface of the base housing 152 against a surface 161 the upper housing 154 at a contact interface 160 is shown in FIG. 12.

By virtue of its construction, the tongue 130 also supports, with its increasing exposure between the base and upper housings (see FIG. 13), a degree of twisting movement 182 to provide other degrees of movement freedom to the load carriage that are beyond and complementary to rotation 180 of the back brace around the base pin, the vertical extension 194 of the telescopic back brace and bending 186 of the tongue 130. Since the guide positively engages against the tongue 130 at varying points depending upon overall separation, a point of engagement on the tongue can become part of the force path that commutes the point of action of the load between the wearer's girdle and shoulders. In effect, a limited bending moment is created about the contact point on the tongue, although the degree of inclination of the upper body (relative to the perpendicular) quickly sees that load is borne by the shoulder supports and thus generally transferred to the shoulders and therefore away from the girdle. The tongue 130 therefore takes on varying degrees of load from zero (where the base and upper housings are in abutting engagement) to higher levels of load that depend on a change to the centre of gravity of the load carriage and the amount of load seen to act through the shoulder supports 98, 100. At an upper body inclination of ninety degrees to the vertical, the load carriage provides limited mechanical advantage to the user since the load is born predominantly through the user's shoulders and less so through the back brace 96.

The tongue 130 (and particular the telescopic section) is therefore positioned relative to the lower back of the wearer since any significant bending originates from the base of the spine. Of course, the multi-element telescopic back brace 96 could be articulated at several points through the use of multiple interlocking tongues and guide rail systems (as described herein), although this increases the complexity of the back brace 96.

In a preferred embodiment, the tongue 130 includes a catch 158, such as a T-shaped head, designed to prohibit the removal of the tongue from the guide channel or rail 156 in the upper housing. More specifically, one or more lugs 162 (or other appropriately shaped "retainer", such as a tether) is/are formed or otherwise secured within the upper housing 164, with this retainer cooperating with the guide channel or rail 156 to prohibit full withdrawal of the tongue 130 (through engagement against the T-shaped locking head) when the tongue 130 is assembled and loaded into the guide channel or rail 156.

Figure 13:
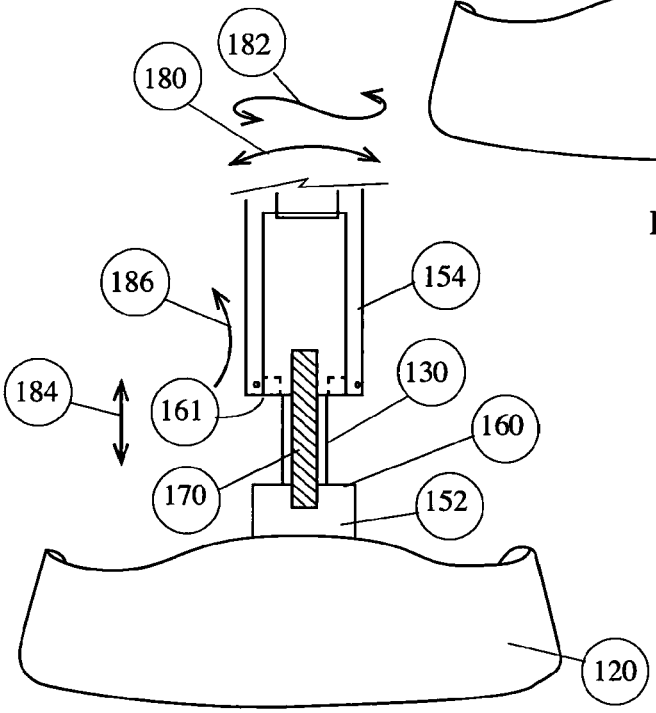

Furthermore, in a preferred embodiment, the upper and base housing are positively urged together. As shown in FIGS. 12 and 13 (although omitted from FIG. 11 for reasons of clarity), a resistive cord or spring 170 is preferably attached to both the base housing 152 and the upper housing 154 to encourage compression and abutment at the contact interface 160 and therefore to promote weight distribution (subordinate to the an overall centre of gravity) to the pelvic girdle via the belt 120. The resistive cord or spring 170 is configured to provide some resistance against telescopic movement, but not to realise a force that would require significant effort to overcome when bending was being undertaken. The resistive cord or spring 170, such as a piece of elasticated webbing material, therefore only assists the natural action of gravity that encourages (when the wearer of the load carriage is generally standing upright) the upper housing 154 to return to a neutral rest position against the base housing.

The tongue 130 could, in fact, be reversed and feed down into the upper housing 164, rather than to be located in and extend upwardly from the base housing 152. The guide rails or channel would also therefore be reversed. The slideable relative movement, as will be appreciated, remains the same between the lower section 112 and the upper section 110 of the back brace 96.

FIG. 14 show a ratchet release system 200 for a user-adjustable back brace 11, 96, the ratchet release system 200 integrated in the load carriage of FIGS. 9 to 13 or the load transfer device of FIGS. 1 to 12. The ratchet release system 200 can therefore be implemented either independently of the telescopic back brace 96 or complementary to the multi-element telescopic back brace 96.

The ratchet release system 200 is incorporated within the support belt 120 and typically located within a protective void 202 defined by padding 204 that attaches internally to the support belt. A pull cable 206 attaches to the ratchet system 200 to provide actuation by the wearer/user. Actuation of the ratchet system 200 has the effect of lowering or raising the shoulder pads (as illustrated by a horizontal datum line 210 and relative position on a user 212) by adjusting the effective length of the back brace 11, 96. FIG. 15 shows the relative physical loading, on a body of the wearer 212, achieved by operating the ratchet release system 200.

Figure 17:
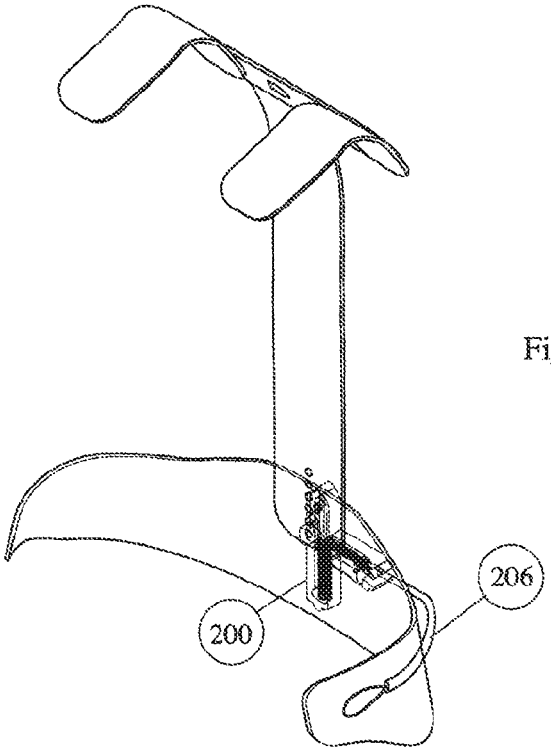
FIG. 17 is a perspective view of the load carriage assembly of FIG. 16.
Figure 16:
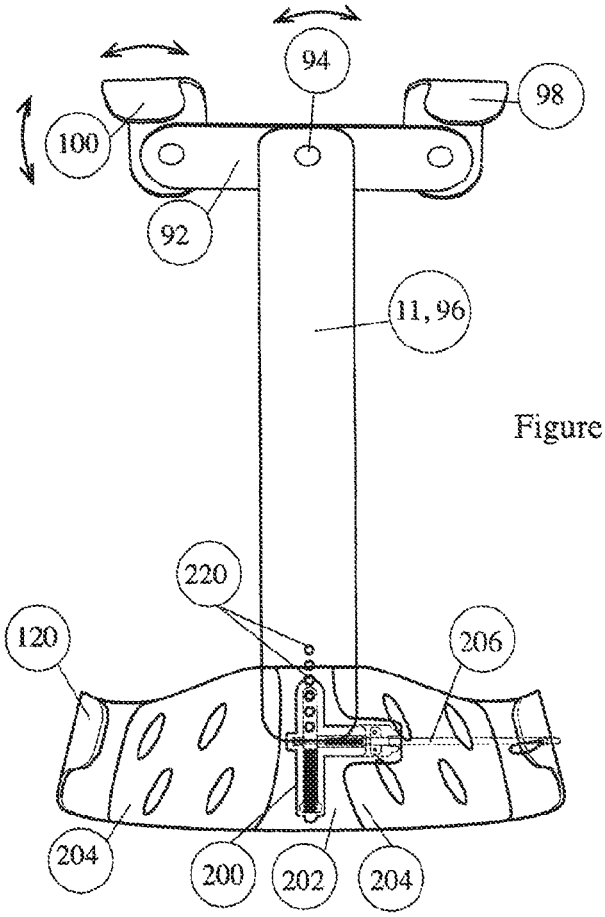
FIG. 16 shows a load carriage having a varying point of pivotal attachment between a pelvic belt and a back brace, the point of attachment governed by the ratchet release system of FIG. 14.

FIG. 16 shows a load carriage 80 having a varying point of pivotal attachment between the support belt 120 (having an adjustable fastening buckle 207) and the back brace 11, 96. FIG. 17 is a perspective view of the load carriage assembly of FIG. 16. FIG. 16 shows a plurality of through holes 220 formed at a lower point in the back brace 11, 96. Typically, these holes are formed at regularly or scaled intervals across a distance about five to eight centimeters. The number of holes and the distance is arbitrary. The diameter of the holes is marginally larger than the diameter of a locking pin or locking bolt 235.

Figure 18:
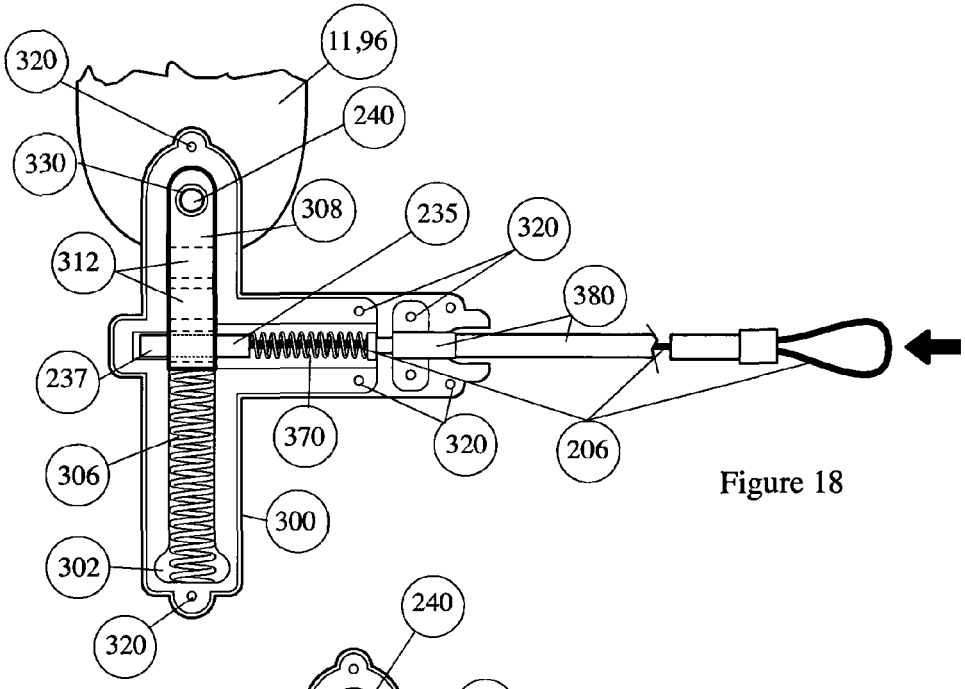
FIGS. 18 to 20 show the preferred ratchet release system of FIG. 14 in multiple engaged states and a single disengaged state permitting user-initiated, back brace length adjustment.
Figure 19:
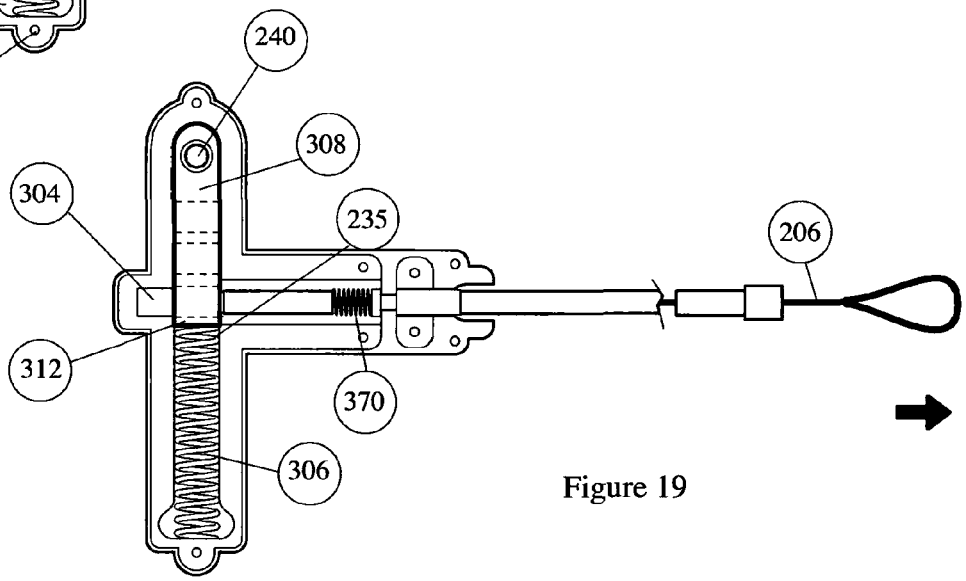
Figure 20:
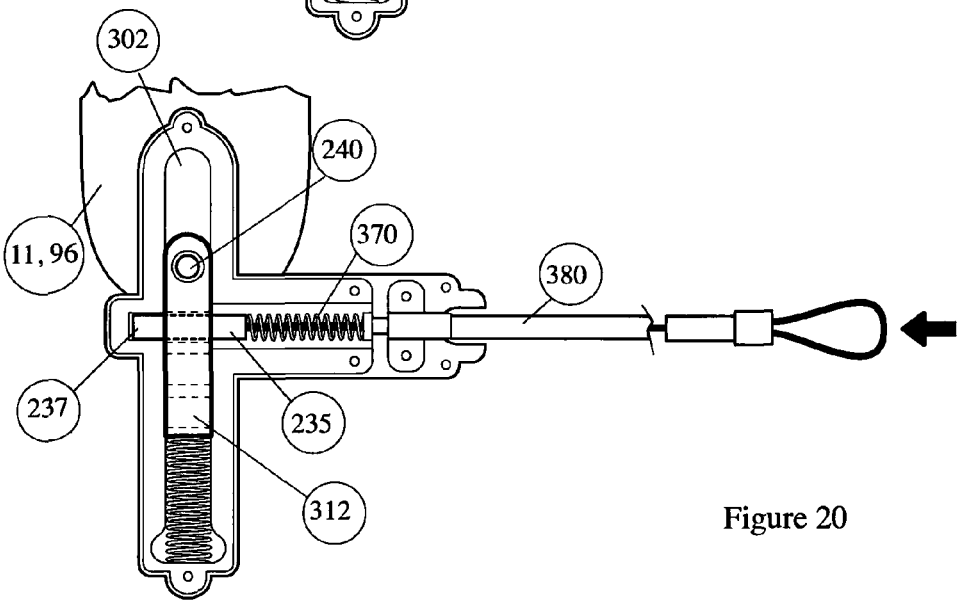

Reference is now made to FIGS. 18 to 20 that show, in greater detail, an arrangement and general operation of the preferred ratchet release system 200. A ratchet housing 300 includes a vertical channel 302 that is intersected by a generally horizontal channel 304. The vertical channel houses a bracing spring 306 attached to an elongate ratchet member 308 and a base of the vertical channel. The base spring preferably biases the ratchet away from the base of the vertical channel 306, although the base spring can alternatively be configured to pull the ratchet downwards into the base of the vertical channel. The first configuration where there is a push away is preferred because this avoids the possibility of inadvertently separating the multi-element back brace.

The ratchet housing 300 is attached to the support belt by rivets, screws or other fixing means 320.

The ratchet member includes plurality of lock pin through holes 312 running transverse to a direction of movement of the ratchet member 308 within the vertical channel 302.

At the top of the ratchet member 308, a base pin bore hole 330 accepts the base pin 240. The base pin bore hole 330 is therefore drilled perpendicular to the through holes 312. When the base pin is inserted through the base pin bore hole 330 and locked in place by a clip or the like (not shown), the ratchet is coupled to the back brace 11, 96. With the ratchet housing securely attached to the support belt 120, the base pin 240 therefore allows for relative rotation of the back brace 11, 96 about the base pin 240.

The base pin 240 could be realised by a nut and bolt.

The locking pin 235 is biased by a locking spring 370 within the horizontal channel 304 such that the default position of the locking pin is to be urged against/through the through holes 312 in the ratchet member 308. When aligned with a through hole (which in a default position is a through hole nearest the base pin bore hole 330), a distal end 237 of the locking pin 235 extends through the ratchet member 308; this is seen in FIG. 20. A through hole is preferred for reasons of security, although it could be a recess or indentation of sufficient depth to positively engage the distal end of the locking pin 235.

The pull cable 206, fed through a protective sleeve 380, attaches to a second end of the locking pin 235. The second end is opposite the distal end. When pulled, the pull cable 206 acts to compress the locking spring 370 in the horizontal channel 304, thereby disengaging the locking pin 235 from the ratchet member 308 through withdrawal of the locking pin 235 from one of the through holes 312. This means that the point of rotation of the back brace around the base pin can be changed by pulling the pull cable and then releasing the pull cable to re-engage a different through hole 312 in the ratchet member 308. With the bracing spring 306 pulling the back brace 11, 96 down into the ratchet housing, having the wearer hunch their shoulders provides a simple way to set the height at which the pull cable can be released and the locking pin allowed to re-engage through the a new through hole 312. Disengagement of the locking pin 235 is shown in FIG. 19. Engagement of the locking pin 235 through the ratchet is shown in FIGS. 18 and 20.

In effect, the ratchet system (or an equivalent functional arrangement) provides a means by which the position of the point of rotation of the back brace 11, 96 is selectively changed relative to the support belt 120 (and more particularly the relative position of the ratchet member 308 within its channel). This has the effect of altering the length of the back brace and therefore the position of the shoulders of the load carriage on the wearer (as shown in FIG. 15). Change in the height and thus the load characteristics of the load carriage can therefore be changed according to requirements and at the whim of the wearer (reference numeral 212 of FIG. 15).

Figure 21:
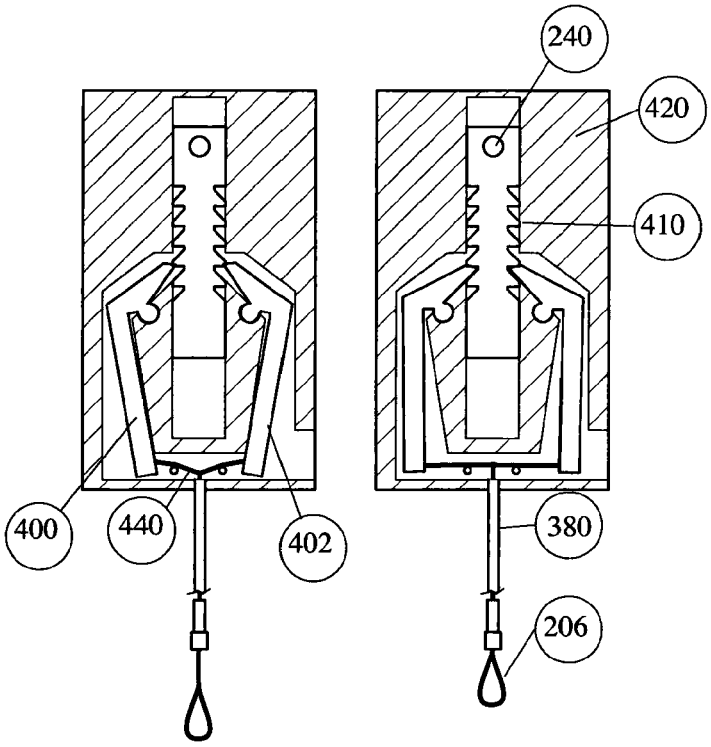
FIG. 21 shows a first alternative configuration for an active ratchet deployable within a load carriage.

FIG. 21 shows a first alternative configuration for an active ratchet deployable within a load carriage. Specifically, the horizontal channel has been removed, with height setting realized by engagement of pivoted and biased clamping pincer arms 400, 402 within splines 410 formed on an external surface of a ratchet member 420. The clamping pincer arms 400, 402 may therefore be functionally equated to the locking pin of FIG. 18. The size and shape of the ratchet housing is therefore different to that shown in FIG. 20, for example. Also, rather than a perpendicular pull on a release cord (or webbing strap) 206, a pincer biasing spring 440 allows for a downward movement to disengage the clamping pincers 400, 402 from the splines. The use of external splines 410 may allow for a higher degree of height selection, subject to overall pitch between splines 410. The term spline should be understood to include a lip, undercut or dog and all functional equivalents.

Figure 22:
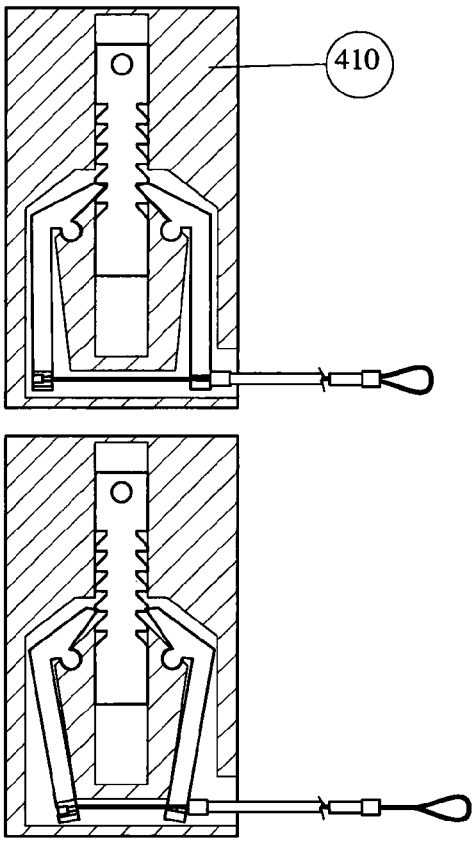
FIG. 22 shows another alternative configuration for an active ratchet deployable within a load carriage.

FIG. 22 shows another alternative configuration for an active ratchet deployable within a load carriage. Essentially, the pincers 400, 402 are activated by a laterally extending release cord.

Detailed explanation of FIGS. 21 and 22 is not believed to be necessary since these ratchet release systems are mechanical equivalent systems to that described in relation to FIGS. 18 to 20. A person of ordinary skill in the art is therefore able to implement and modify the release mechanism armed with the instruction that a common objective is to provide a means by which the position of the point of rotation of the back brace can be selectively changed relative to the support belt 120 and that the effect that is achieved is to alter the length of the back brace and therefore the position of the shoulders of the load carriage on the wearer (as shown in FIG. 15).

It will be further understood that unless features in the particular preferred embodiments are expressly identified as incompatible with one another or the surrounding context implies that they are mutually exclusive and not readily combinable in a complementary and/or supportive sense, the totality of this disclosure contemplates and envisions that specific features of those complementary embodiments can be selectively combined to provide one or more comprehensive, but slightly different, technical solutions.

It will, of course, be appreciated that the above description has been given by way of example only and that modifications in details may be made within the scope of the present invention. For example, while a preferred embodiment describes a device that is suitable for use with body armour, the present invention finds wider application in the general load carriage field. Specifically, the aspects of the present invention may be integrated into any jacket or vest to enable it to transfer weight effectively from the shoulders to the pelvic girdle. Moreover, while the preferred embodiment is deployed under (or integrated into) body armour, the frame of the present invention may form the basis of a garment designed to be worn by firemen, emergency workers, labourers or other people who need to carry loads. All of these can make use of the garment/apparel of the preferred embodiments of the present invention.

Unless the context otherwise requires a strict literal interpretation of the word "tongue", this work should be understood to extent to and include any connecting element that extends from one of the upper and lower sections of the multi-element back brace and which engages into and around (or which is captured and retained by) the other respective one of the lower or supper sections of the multi-element back brace. The term "ratchet assembly" or "ratchet system" or the like are equivalent and should collectively be construed in context to relate to any release mechanical mechanism that activity alters the length of the back brace by releasing and then re-engaging the back brace to adjust the length of the back brace and therefore the position of the shoulders of the load carriage on the wearer.

It is further contemplated that the ratchet system may, in fact, be replaced by a simple cross bolt, although access to the cross bolt is potentially more problematic.

The invention claimed is:

1. An active load carriage frame comprising:

a shoulder yoke;

a belt for securing, in use, about a pelvic girdle; and a multi-element connecting brace separating the shoulder yoke from the belt, the multi-element connecting brace centrally coupled to the yoke and centrally coupled to the belt and configured to act as a force path to transfer weight that, in use, is loaded onto or through the yoke and into the belt, and wherein:

the multi-element connecting brace comprises:

an upper section and a lower base section that are continuously slideably engageable with each other through a flexible connecting element, wherein the connecting element extends from and is fixedly coupled to one of the upper section or the lower base section and is engageable at a variable coupling point along part of its length by the other one of said lower base section or said upper section, the variable coupling point being, at times, part of the force path between the shoulder yoke and the belt and wherein the variable coupling point varies dynamically along the flexible connecting element from relative movement of one of the upper section or the lower section along the flexible connecting element; and wherein the multi-element connecting brace is thereby arranged to affect, with variation of the variable coupling point, weight distribution onto the pelvic girdle of a wearer about which the belt, in use, is secured.

2. The active load carriage frame according to claim 1, wherein the flexible connecting element is a tongue that engages into a guide channel that defines longitudinal travel for the tongue.

3. The active load carriage frame according to claim 2, wherein the tongue is coupled to the upper section and extends downwardly from the upper section towards the guide channel formed in the lower base section of the multi-element connecting brace.

4. The active load carriage frame according to claim 2, wherein the flexible connecting element includes catch limiting movement of the connecting element to within the guide channel.

5. The active load carriage frame according to claim 1, wherein the flexible connecting element is configured to bend and twist.

6. The active load carriage frame according to claim 1, wherein the flexible connecting element is a para-aramid-resin composite.

7. The active load carriage frame according to claim 1, wherein the multi-element connecting brace is pivoted at its point of connection to at least one of:

a) the shoulder yoke; and b) the belt, thereby allowing the wearer's shoulders and/or the torso independent movement.

8. The active load carriage frame according to claim 1, wherein the shoulder yoke includes shoulder pads attached at peripheral ends of a cross member centrally pivotally coupled to an upper section of the multi-element connecting brace.

9. The active load carriage frame according to claim 1, further comprising bias means arranged to urge, upon separation, the upper section of the multi-element connecting brace towards the lower base section.

10. The active load carriage assembly of according to claim 1, further comprising:

a ratchet assembly fixed centrally in the belt, the ratchet assembly including:

a quick-release locking mechanism including a locking pin; and a moveable member contained within a housing, the moveable member having:

a first end containing a connection point;

a second end opposite the first end; and a plurality of engageably selectable holes or splines extending along the length of the moveable member away from the first end towards the second end, each of the plurality of engageably selectable holes or splines receptive to engagement by the locking pin;

wherein the connecting brace is rotatably coupled to the moveable member at the connection point, and wherein the quick-release locking mechanism is arranged to permit the locking pin to be selectively engaged into a selected one of the plurality of holes or splines, thereby altering the relative position of the connection point within the housing.

11. The active load carriage frame according to claim 10, wherein the moveable member is positively biased within a channel in the housing.

12. A load carriage system including a vest attached to the shoulder yoke of the load carriage frame of claim 1.

13. The load carriage system of claim 12, wherein the yoke is mounted below an armour vest and holds up body armour within the vest.

14. The load carriage system of claim 12, wherein load carriage frame is integrated into the vest.

15. An active load carriage frame comprising:

a shoulder yoke;

a belt for securing, in use, about a pelvic girdle; and a multi-element connecting brace separating the shoulder yoke from the belt, the multi-element connecting brace centrally coupled to the yoke and centrally coupled to the belt and configured to act as a force path to transfer weight that, in use, is loaded onto or through the yoke and into the belt, and wherein:

the multi-element connecting brace comprises:

an upper section and a lower base section that are continuously slideably engageable with each other through a flexible connecting element, wherein the connecting element extends from and is fixedly coupled to one of the upper section or the lower section and is engageable at a variable coupling point along part of its length by the other one of said lower base section or said upper section, the flexible connecting element automatically adjusting separation between the shoulder yoke and the belt by acting as a bridge between the upper section and the lower base section and wherein the variable coupling point varies dynamically along the flexible connecting element from relative movement of one of the upper section or the lower section along the flexible connecting element; and wherein the multi-element connecting brace is thereby arranged to affect, with variation of the variable coupling point, weight distribution onto the pelvic girdle of a wearer about which the belt, in use, is secured.

16. The active load carriage frame according to claim 15, wherein the shoulder yoke includes shoulder pads attached at peripheral ends of a cross member centrally pivotally coupled to an upper section of the multi-element connecting brace.

17. The active load carriage frame according to claim 15, wherein the flexible connecting element is a tongue that engages into a guide channel that defines longitudinal travel for the tongue.

18. The active load carriage frame according to claim 17, wherein the tongue is coupled to the upper section and extends downwardly from the upper section towards the guide channel formed in the lower base section of the multi-element connecting brace.

19. The active load carriage assembly of according to claim 15, further comprising:

a ratchet assembly fixed centrally in the belt, the ratchet assembly including:

a quick-release locking mechanism including a locking pin; and a moveable member contained within a housing, the moveable member having:

a first end containing a connection point;

a second end opposite the first end; and a plurality of engageably selectable holes or splines extending along the length of the moveable member away from the first end towards the second end, each of the plurality of engageably selectable holes or splines receptive to engagement by the locking pin;

wherein the connecting brace is rotatably coupled to the moveable member at the connection point, and wherein the quick-release locking mechanism is arranged to permit the locking pin to be selectively engaged into a selected one of the plurality of holes or splines, thereby altering the relative position of the connection point within the housing.

20. The active load carriage frame according to claim 19, wherein the moveable member is positively biased within a channel in the housing.

21. A load carriage frame comprising:

a shoulder yoke;

a belt for securing, in use, about a pelvic girdle; and a ratchet assembly fixed centrally in the belt, the ratchet assembly including:

a quick-release locking mechanism including a locking pin; and a moveable member contained within a housing, the moveable member having:

a first end containing a connection point;

a second end opposite the first end; and a plurality of engageably selectable holes or splines extending along the length of the moveable member away from the first end towards the second end, each of the plurality of engageably selectable holes or splines receptive to engagement by the locking pin;

a connecting brace separating the shoulder yoke from the belt, the connecting brace centrally coupled to the yoke and rotatably coupled to the moveable member at the connection point, the connecting brace configured to act as a force path by transferring weight that, in use, is loaded onto or through the yoke and into the belt thereby effecting selective weight re-distribution onto the pelvic girdle of a wearer about which the belt, in use, is secured;

wherein the quick-release locking mechanism is arranged to permit the locking pin to be selectively engaged into a selected one of the plurality of holes or splines, thereby altering the relative position of the connection point within the housing.

22. The load carriage frame according to claim 21, wherein the moveable member is positively biased within a channel in the housing.

23. The load carriage frame according to claim 21, wherein the locking pin is biased by a spring.

* * * * *